US007527516B2

(12) United States Patent
Honda et al.

(10) Patent No.: US 7,527,516 B2
(45) Date of Patent: May 5, 2009

(54) PORTABLE ELECTRONIC DEVICE

(75) Inventors: Kazuki Honda, Mie (JP); Mitsutaka Enomoto, Nara (JP); Toshiharu Takahashi, Mie (JP); Shoji Nakajima, Mie (JP); Kyoichi Hasegawa, Osaka (JP); Masahide Sumiyama, Mie (JP)

(73) Assignee: Panasonic Corporation, Osaka (JP)

( * ) Notice: Subject to any disclaimer, the term of this patent is extended or adjusted under 35 U.S.C. 154(b) by 64 days.

(21) Appl. No.: 11/578,192

(22) PCT Filed: May 18, 2005

(86) PCT No.: PCT/JP2005/009043

§ 371 (c)(1),
(2), (4) Date: Oct. 11, 2006

(87) PCT Pub. No.: WO2005/115047

PCT Pub. Date: Dec. 1, 2005

(65) Prior Publication Data

US 2007/0218732 A1 Sep. 20, 2007

(30) Foreign Application Priority Data

May 20, 2004 (JP) ..... 2004-149979
Jul. 1, 2004 (JP) ..... 2004-195192

(51) Int. Cl.
*H01R 13/648* (2006.01)

(52) U.S. Cl. ..... 439/382; 381/407

(58) Field of Classification Search ..... 439/862, 439/948; 381/409–412, 407; 379/433.02–433.03
See application file for complete search history.

(56) References Cited

U.S. PATENT DOCUMENTS 4,420,706 A * 12/1983 Siebold et al. ..... 310/324
4,738,625 A * 4/1988 Burton et al. ..... 439/59
6,553,126 B2 4/2003 Han et al.
6,590,991 B1 * 7/2003 Maeda ..... 381/409
6,674,872 B2 * 1/2004 Fujinami et al. ..... 381/409
6,807,282 B2 10/2004 Kaneda et al.

(Continued)

FOREIGN PATENT DOCUMENTS

EP 1120991 8/2001

(Continued)

OTHER PUBLICATIONS

Supplementary European Search Report issued Jan. 7, 2009 in European Application No. EP 05 73 8748 which is a foreign counterpart to the present U.S. application.

*Primary Examiner*—Renee Luebke
*Assistant Examiner*—Larisa Tsukerman
(74) *Attorney, Agent, or Firm*—Wenderoth, Lind & Ponack, L.L.P.

(57) ABSTRACT

A portable electronic device includes an electronic component, a spring terminal extending from the electronic component to supply power to the electronic component, a circuit component having a power supply section contacting the spring terminal, and a stopper for restricting a movement of the electronic component. The spring terminal has a reversible deformation limit of elastic deformation. The stopper restricts the movement of the electronic component within the reversible deformation limit of the spring terminal. This portable electronic device prevents a spring pressure of the spring terminal from decreasing, hence supplying power to the electronic component stably.

7 Claims, 8 Drawing Sheets

U.S. PATENT DOCUMENTS

| | | | | |
|---|---|---|---|---|
| 6,860,766 | B2 | 3/2005 | Aujla et al. | |
| 7,181,040 | B2 | 2/2007 | Ohta | |
| 7,200,241 | B2 * | 4/2007 | Fukuyama et al. | 381/407 |
| 2001/0053233 | A1 | 12/2001 | Fukazawa et al. | |
| 2004/0037441 | A1 * | 2/2004 | Konishi et al. | 381/190 |
| 2005/0152536 | A1 | 7/2005 | Caveney | |
| 2006/0177092 | A1 * | 8/2006 | Ohta | 381/423 |
| 2007/0080412 | A1 * | 4/2007 | Honda et al. | 257/416 |

FOREIGN PATENT DOCUMENTS

| | | |
|---|---|---|
| EP | 1146773 | 10/2001 |
| JP | 7-16494 | 3/1995 |
| JP | 11-025946 | 1/1999 |
| JP | 2003-037890 | 2/2003 |
| WO | 00/59263 | 10/2000 |
| WO | 2005-107316 | 11/2005 |
| WO | 2005-107317 | 11/2005 |
| WO | 2005/115047 | 12/2005 |

* cited by examiner

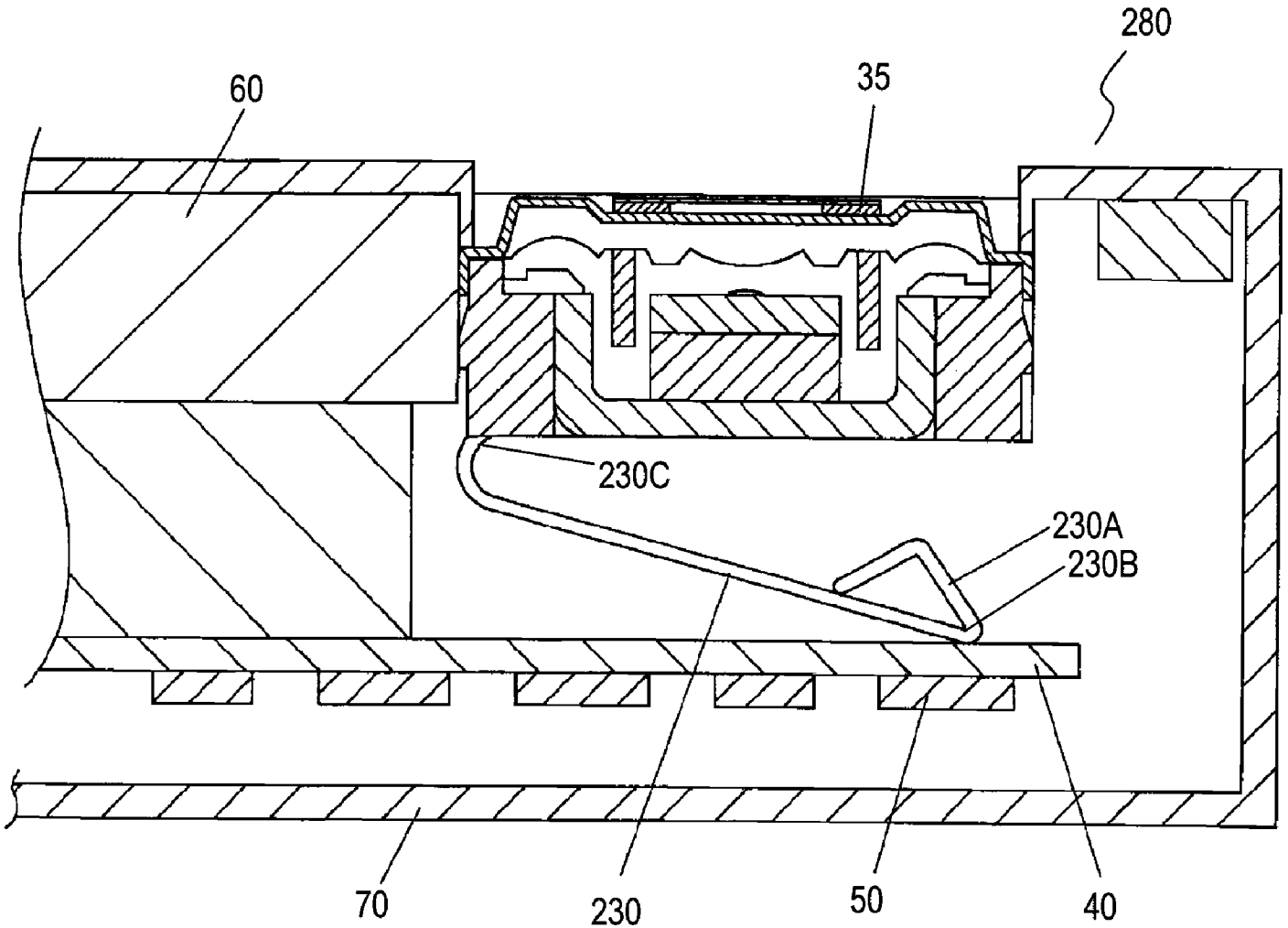
Fig. 7 – PRIOR ART

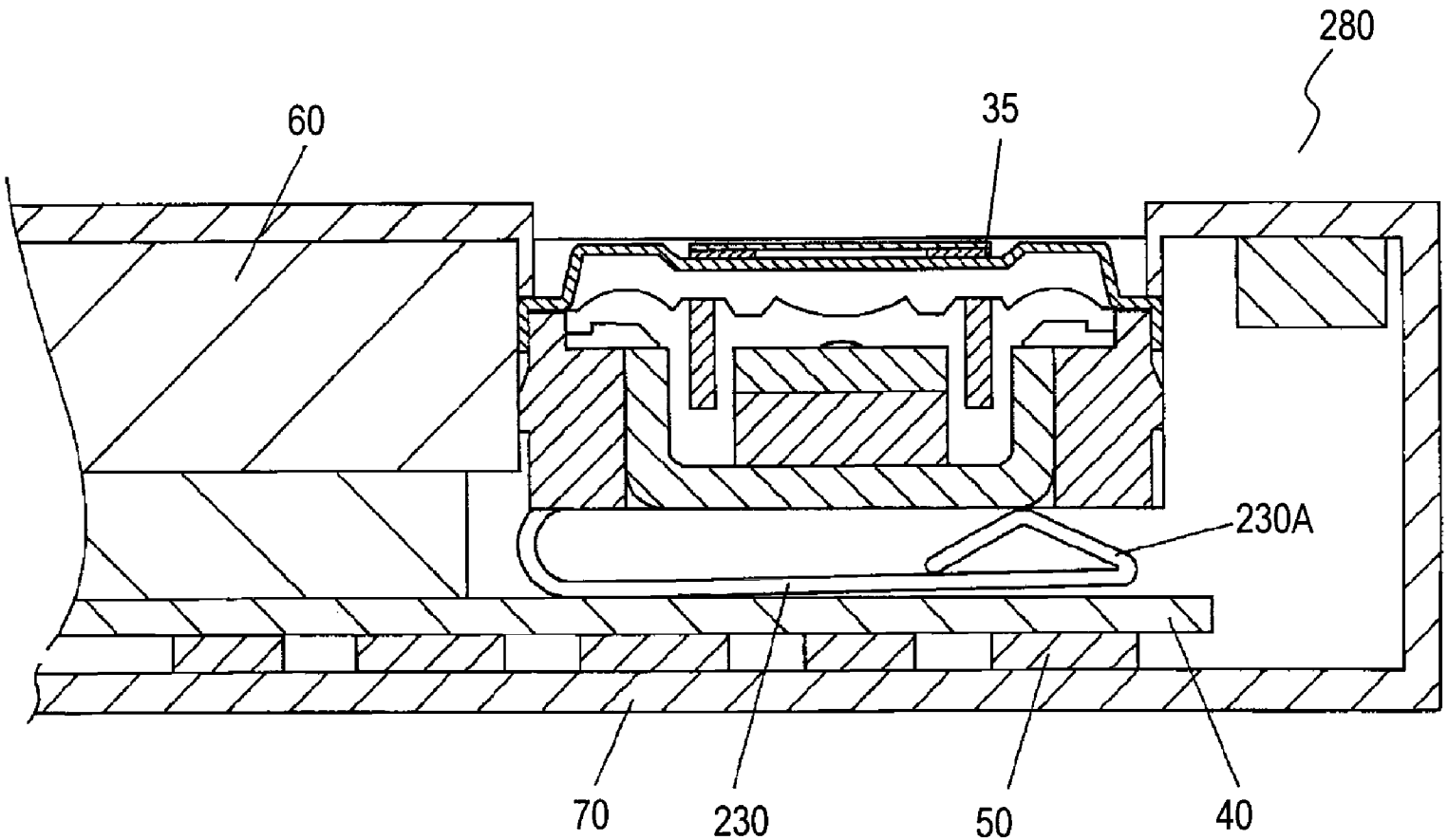
Fig. 8 – PRIOR ART

PORTABLE ELECTRONIC DEVICE

TECHNICAL FIELD

The present invention relates to a portable electronic device, such as a portable phone or game machine used as any of various video audio devices or information communication devices.

BACKGROUND ART

FIG. 7 and FIG. 8 are sectional views of an essential part of a conventional portable electronic device, portable phone 280 disclosed in Japanese Patent Laid-Open Publication No. 2003-37890 and Japanese Patent Laid-Open Publication No. 11-25946. Portable phone 280 includes loudspeaker 35, circuit component 40 having electronic component 50 mounted thereto, display module 60, such as a liquid crystal display, and case 70 for storing them. Spring terminal 230 is formed by folding a single sheet-like elastic metal plate having conductivity, and one end 230C of spring terminal 230 is mounted to the loudspeaker. Spring terminal 230 extending from loudspeaker 35 receives a pressure from circuit component 40, contacts a power supply section of circuit component 40 at an appropriate spring pressure, and supplies power to activate loudspeaker 35.

The other end of spring terminal 230 is folded toward loudspeaker 35 to form folded section 230A, so to prevent spring terminal 230 from elastically deforming and contacting loudspeaker 35 over a reversible deformation limit of elastic deformation of the metal plate. Folded section 230A regulates a range within which spring terminal 230 of the metal plate can be folded, and restricts the distance between the other end 230B of spring terminal 230 and loudspeaker 35 so that the distance is longer than a predetermined value.

Portable electronic devices, such as portable phone 280, game machines, or navigation systems, have recently had small sizes, and the market thereof has grown. Accordingly, portable electronic devices may be handled roughly. Upon being dropped accidentally, being carried in a bag, or receiving an impact force while it is left in an automobile, portable electronic devices may be significantly damaged unintentionally.

FIG. 8 is a sectional view of spring terminal 230 of portable phone 280 shown in FIG. 7 which has received an excessive impact due to an external factor, such as a drop impact and is thus deformed to a smaller thickness. Spring terminal 230 is pressed to circuit component 40 to deform, and folded section 230A deforms and is crushed. In this case, spring terminal 230 deforms over its reversible deformation limit, and does not return to its original shape, thus causing permanent deformation even when the pressure applied from circuit component 40 is eliminated. The spring pressure of spring terminal 230 is decreased. This disables spring terminal 230 to provide a strong spring pressure, accordingly preventing the spring terminal from stably contacting the power supply section of circuit component 40. Upon receiving an impact or vibration, portable phone 280 may produce contact failure between spring terminal 230 and circuit component 40, or may cause a signal to loudspeaker 35 to be interrupted.

SUMMARY OF THE INVENTION

A portable electronic device includes an electronic component, a spring terminal extending from the electronic component to supply power to the electronic component, a circuit component having a power supply section contacting the spring terminal, and a stopper for restricting movement of the electronic component. The spring terminal has a reversible deformation limit of elastic deformation. The stopper restricts the movement of the electronic component within the reversible deformation limit of the spring terminal.

This portable electronic device prevents a spring pressure of the spring terminal from decreasing, hence supplying power to the electronic component stably.

BRIEF DESCRIPTION OF DRAWINGS

FIG. 7 is a sectional view of a conventional portable electronic device.

FIG. 8 is a sectional view of the conventional portable electronic device.

DETAILED DESCRIPTION OF THE PREFERRED EMBODIMENTS

Exemplary Embodiment 1

Figure 1:
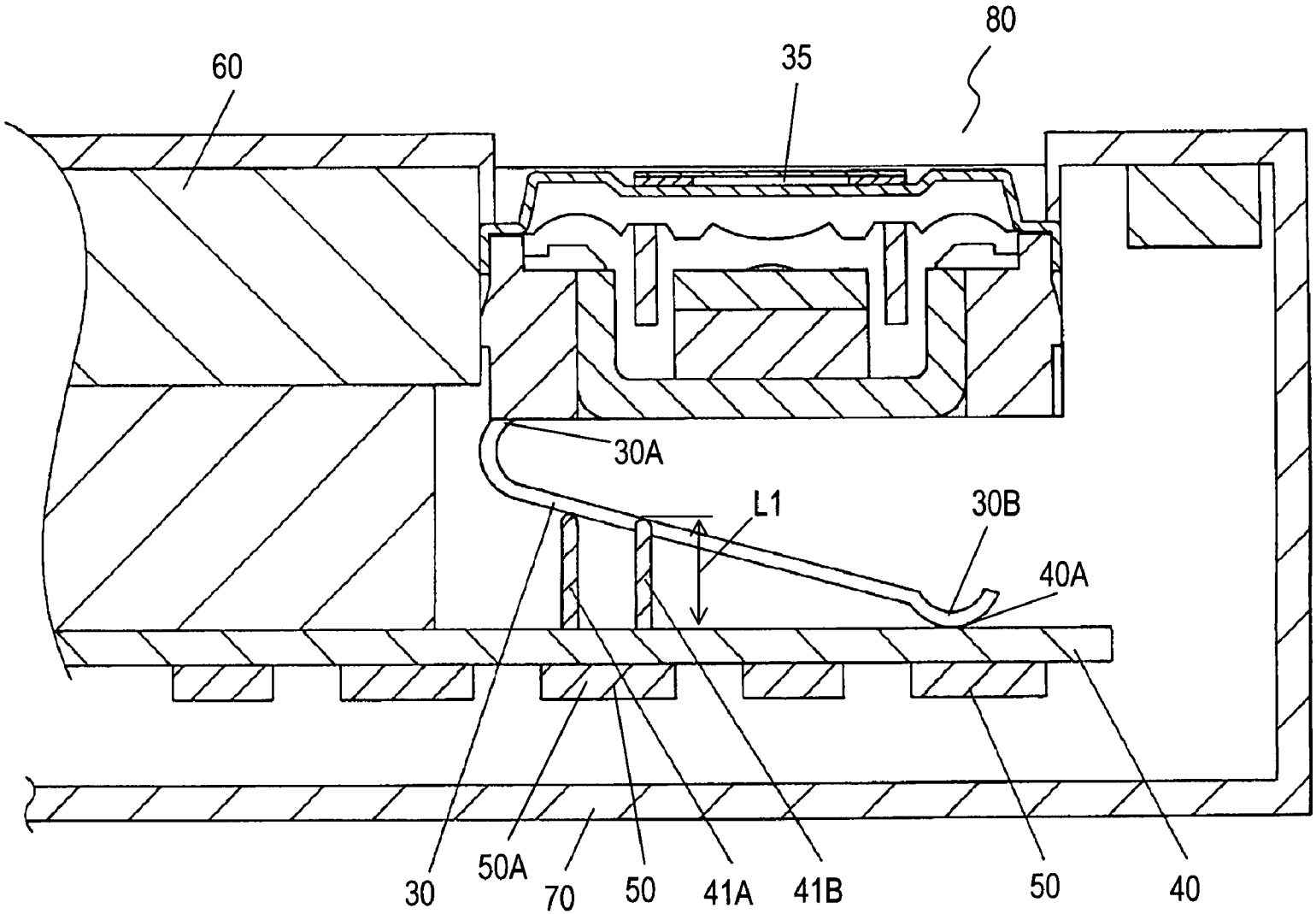
FIG. 1 is a sectional view of a portable electronic device in accordance with Exemplary Embodiment 1 of the present invention.
Figure 2:
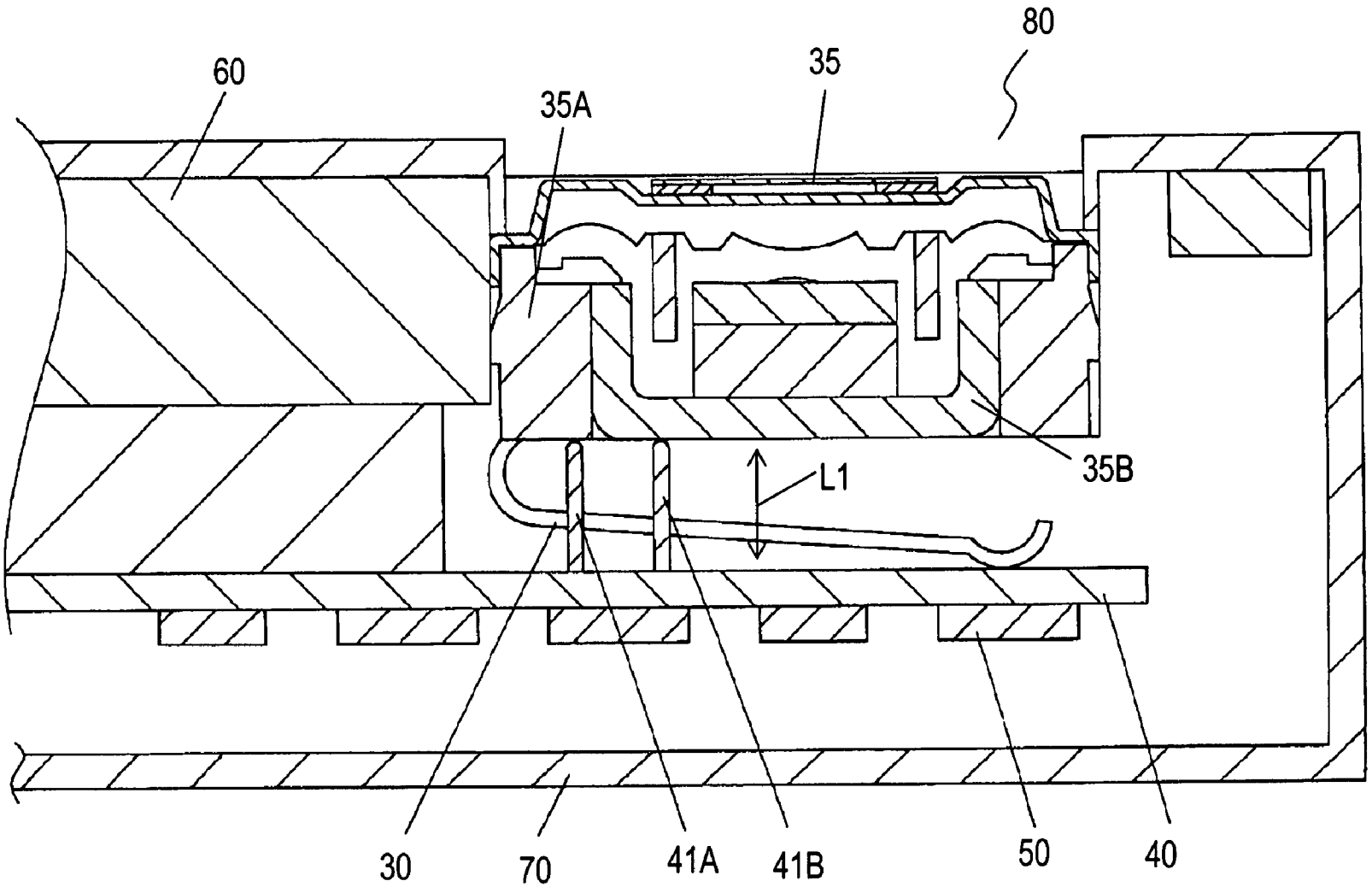
FIG. 2 is a sectional view of the portable electronic device in accordance with Embodiment 1.

FIG. 1 and FIG. 2 are sectional views of portable phone 80, a portable electronic device in accordance with Exemplary Embodiment 1 of the present invention. Portable phone 80 includes loudspeaker 35 as an electronic component, circuit board 40 as a circuit component, display module 60, such as a liquid crystal display, and case 70 for accommodating them therein. Spring terminal 30 is formed by folding a single sheet-like elastic metal plate having conductivity. One end 30A of spring terminal 30 is connected to loudspeaker 35 and extends from loudspeaker 35. Upon receiving a pressure from circuit board 40, other end 30B of spring terminal 30 contacts circuit board 40. Loudspeaker 35 receives power from power supply section 40A of circuit component 40 via spring terminal 30 to operate. When the pressure from circuit board 40 is eliminated, spring terminal 30 returns to its original shape due to its elasticity. However, when the distance between circuit board 40 and loudspeaker 35 is shorter than a predetermined distance, namely, a reversible deformation limit, spring terminal 30 does not return to the original shape even due to its elasticity. Circuit board 40 has electronic component 50 mounted thereon. Terminals of electronic component 50 are soldered to circuit board 40, and form stoppers 41A and 41B each having predetermined length L1.

FIG. 2 is a sectional view of portable phone 80. In FIG. 2, the distance between loudspeaker 35 and circuit board 40 is reduced (e.g., due to reduction in thickness of case 70) by an external factor, such as an impact or pressure, and loudspeaker 35 contacts stoppers 41A and 41B. At this moment, the distance between loudspeaker 35 and circuit board 40 is equal to length L1 of stoppers 41A and 41B. Length L1 is determined to be larger than the reversible deformation limit of elastic deformation of spring terminal 30. Even if an excessive impact force is applied to spring terminal 30 by mounting loudspeaker 35 to a depth position of case 70 or by accidentally dropping portable phone 80, stoppers 41A and 41B prevent spring terminal 30 from permanently deforming and being crushed. That is, stoppers 41A and 41B restrict the movement of loudspeaker 35, so that the movement does not exceed the reversible deformation limit of spring terminal 30.

Stoppers 41A and 41B are made preferably of metallic material. This metallic material prevents stoppers 41A and 41B from bending and breaking even if an excessive force due to dropping impact is applied to the stoppers. Therefore, the stoppers can withstand plural dropping impacts, and have large environmental resistance to heat or chemicals. Stoppers 41A and 41B may be made of other material having resistance to impact, heat, and chemical, instead of the metallic material.

Stoppers 41A and 41B may preferably have reinforcing ribs. Even if the excessive force due to dropping impact is applied, the reinforcing rib further increases the resistance of stoppers 41A and 41B to impact, thus reliably protecting spring terminal 30.

Stoppers 41A and 41B prevent spring terminal 30 of elastic metal from deforming beyond the reversible deformation limit of elastic deformation, accordingly preventing the spring pressure produced by spring terminal 30 from decreasing. Therefore, spring terminal 30 always keeps producing a large spring pressure to stably contact circuit board 40. Thus, even upon receiving an impact or vibration, portable phone 80 does not cause contact failure between circuit board 40 and spring terminal 30. Therefore, loudspeaker 35 is driven stably without interrupting the signal to loudspeaker 35, thus providing a reliable portable electronic device, such as a portable phone.

Circuit component 40 has its original function and a function as stoppers 41A and 41B of spring terminal 30. As shown in FIG. 1, stoppers 41A and 41B receive external impact force in a direction along which the stoppers extend, hence having large resistance to impact. The combination of the original function and the impact resistance can reduce the number of components of the portable electronic device of Embodiment 1, thus reducing its cost.

The terminals of electronic component 50 mounted to circuit component 40 are used as the stoppers. However, the present invention is not limited to this. Body 50A of electronic component 50 may be used as the stopper. (In this case, the side to which the electronic component 50 is mounted is opposite). Electronic component 50 may be a chip component, such as a resistor, a coil, or a capacitor, or an integrated circuit component, such as an integrated circuit (IC) or a large scale integrated circuit (LSI). Electronic component 50 may preferably have a large resistance to compression and impact.

In this structure, spring terminal 30 is bent by a predetermined amount when loudspeaker 35 is mounted to portable phone 80 as to keep having its shape for applying an appropriate spring pressure to power supply section 40A of circuit component 40. Even when loudspeaker 35 is mounted while being strongly pressed, stoppers 41A and 41B contact loudspeaker 35 to prevent spring terminal 30 from moving more.

Even if an excessive impact force is applied to spring terminal 30 due to accidental dropping of portable phone 80, stoppers 41A and 41B prevent spring terminal 30 formed of metallic material from deforming and being crushed beyond the reversible deformation limit of elastic deformation, hence preventing the spring pressure produced by spring terminal 30 from decreasing. Thus, spring terminal 30 keeps producing a large spring pressure, and stably contacts power supply section 40A. Even if portable phone 80 receives an impact or vibration, spring terminal 30 does not cause contact failure with power supply section 40A, hence driving loudspeaker 35, the electronic component, stably without interrupting a signal to the loudspeaker.

As shown in FIG. 2, a receiving section for receiving stoppers 41A and 41B is loudspeaker 35 of an electric acoustic transducer, namely the electronic component having spring terminal 30 mounted thereto. This structure determines the heights of stoppers 41A and 41B accurately. Loudspeaker 35 can have accurate dimensions and be assembled accurately, accordingly determining the height L1 of stoppers 41A and 41B accurately.

Stoppers 41A and 41B contact frame 35A and magnetic circuit 35B of loudspeaker 35 to be received by frame 35A and magnetic circuit 35B, respectively. Frame 35A is usually made of strong material and is directly mounted to a case. Spring terminal 30 is usually mounted to loudspeaker 35 with reference to the frame, so that height L1 of stopper 41A can be determined accurately. Frame 35 may be made of resin. In this case, spring terminal 30 may be insert-molded in frame 35. Frame 35A made of resin has resistance to impact smaller than that of metal, so that magnetic circuit 35B made of metallic material having large resistance to impact receives stopper 41B. Stoppers 41A and 41B are received at portions of frame 35A and magnetic circuit 35B, respectively, so that height L1 of stoppers 41A and 41B can be determined accurately, hence providing large resistance to impact.

Required reliability level depends on the type of the portable electronic device, so that the stoppers can be provided appropriately according to the level, for example, the number of stoppers may be one. Thus, the reliability of the portable electronic device can be improved.

Spring terminal 30 according to Embodiment 1 can be used as a spring terminal which is mounted to a portable electronic device, which produces a spring pressure, and which contacts a power supply section. Loudspeaker 35, an electric acoustic transducer as the electronic component, having spring terminal 130 is mounted to the portable phone as the portable electronic device according to Embodiment 1. However, the kind of the electronic component and the kind of the portable electronic device are not limited to these.

Exemplary Embodiment 2

Figure 3:
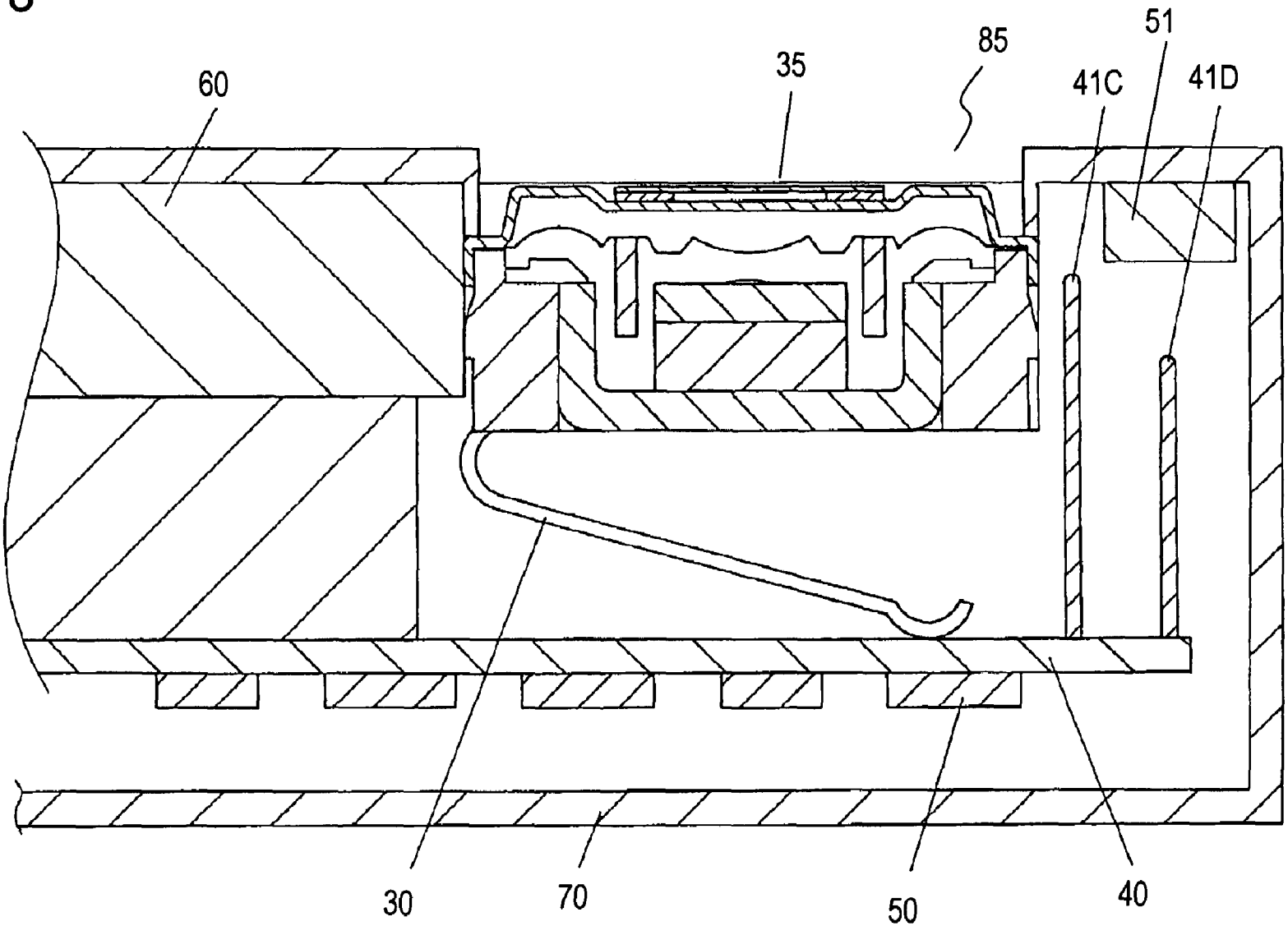
FIG. 3 is a sectional view of a portable electronic device in accordance with Exemplary Embodiment 2 of the invention.

FIG. 3 is a sectional view of portable phone 85, a portable electronic device in accordance with Exemplary Embodiment 2 of the present invention. In FIG. 3, elements similar to those of Embodiment 1 shown in FIG. 1 are denoted by the same reference numerals, and their description is omitted.

Stoppers 41C and 41D extend from circuit board 40, a circuit component, and are made of metallic material having pin shapes. Stoppers 41C and 41D are received by case 70, namely, a component other than electronic component (loudspeaker) 35, and component 51 other than loudspeaker 35 that is an electronic component, respectively. When loudspeaker 35, the electronic component including spring terminal 30, has insufficient resistance to impact, a component, such as case 70, having large resistance to impact and other components, are used as the receiving section for receiving stoppers 41C and 41D. This structure improves reliability and safety, accordingly improving the reliability and safety of the portable electronic device, such as portable phone 85.

Exemplary Embodiment 3

Figure 4:
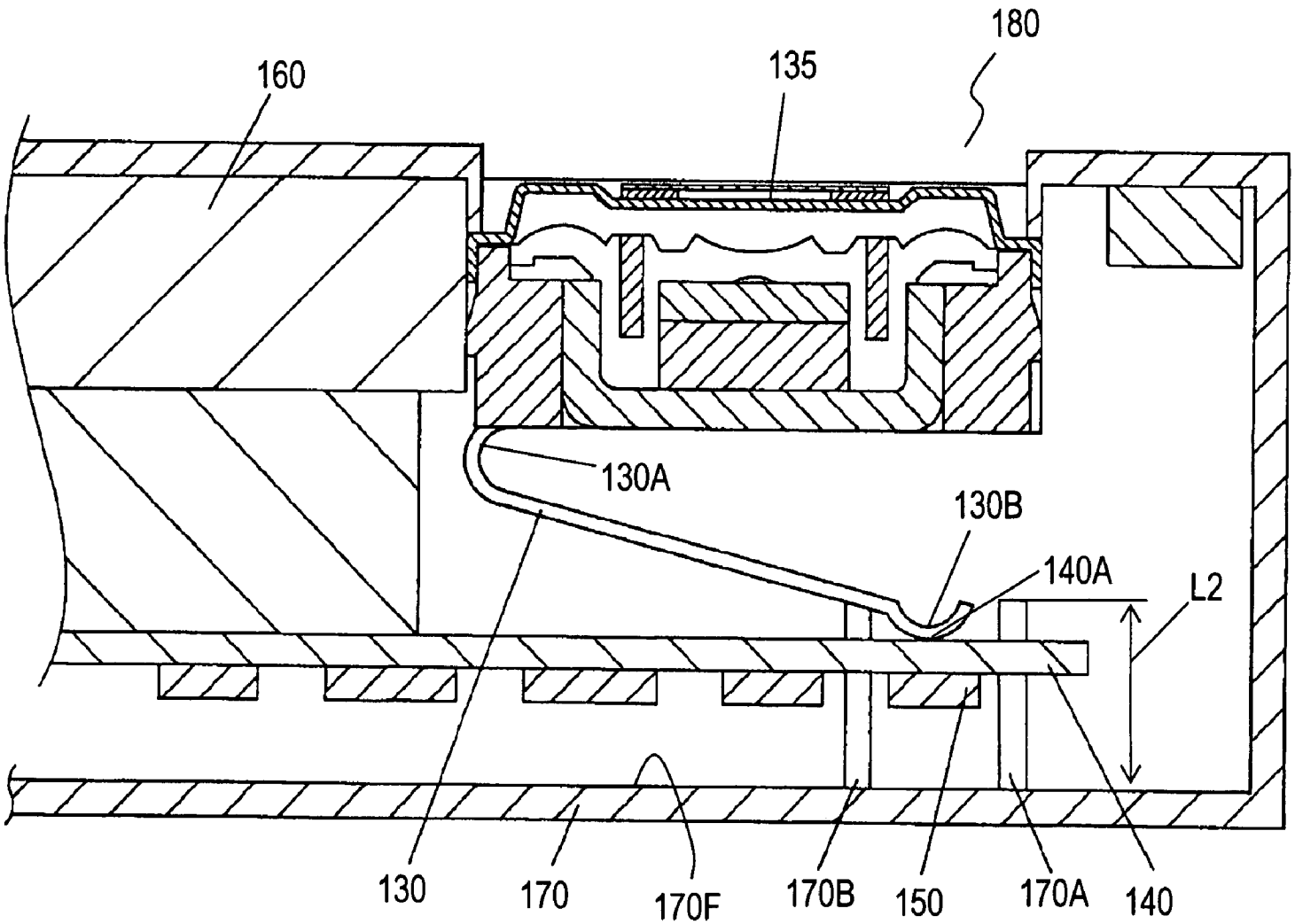
FIG. 4 is a sectional view of a portable electronic device in accordance with Exemplary Embodiment 3 of the invention.
Figure 5:
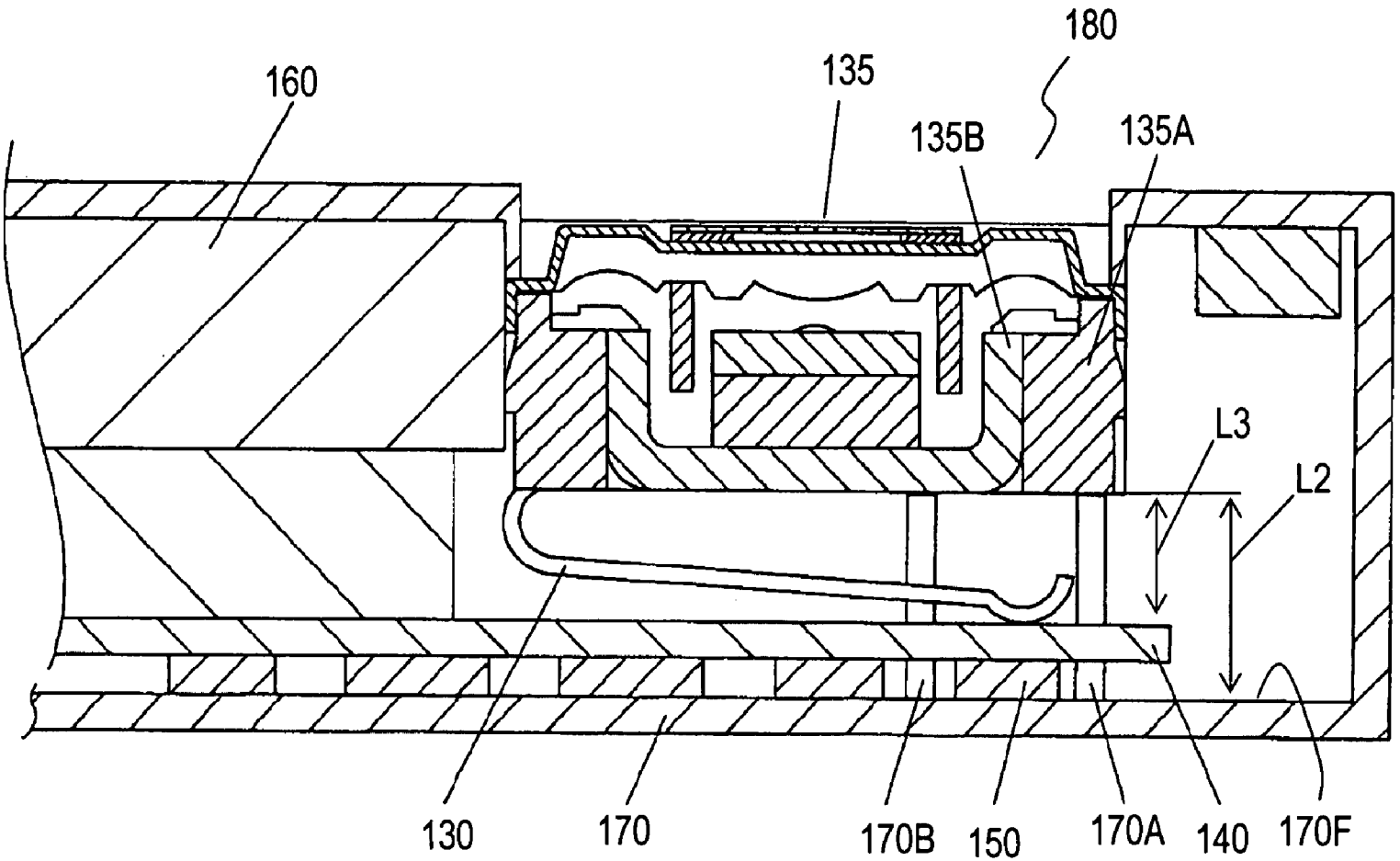
FIG. 5 is a sectional view of the portable electronic device in accordance with Embodiment 3.

FIG. 4 and FIG. 5 are sectional views of portable phone 180, a portable electronic device in accordance with Exemplary Embodiment 3 of the present invention. Portable phone 180 includes loudspeaker 135 as an electronic component, circuit board 140 as a circuit component, display module 160, such as a liquid crystal display, and case 170 for accommodating them therein. Spring terminal 130 is formed by folding a single sheet-like elastic metal plate having conductivity. One end 130A of spring terminal 130 is connected to loudspeaker 135 and extends from loudspeaker 135. Upon receiving a pressure from circuit board 140, other end 130B of spring terminal 130 contacts circuit board 140. Loudspeaker 135 receives power from power supply section 140A of circuit component 140 via spring terminal 130 to operate. When the pressure from circuit board 140 is eliminated, spring terminal 130 returns to have its original shape due to its elasticity. However, when the distance between circuit board 140 and loudspeaker 135 is shorter than a predetermined distance, namely a reversible deformation limit, spring terminal 130 does not return to have the original shape even due to its elasticity. Circuit board 140 has electronic component 150 mounted thereon. Stoppers 170A and 170B each having predetermined length L2 project and extend from inner wall 170F of case 170 facing loudspeaker 35.

In FIG. 5, an external factor, such as an impact or pressure has deformed case 170 to a smaller thickness so as to reduce the distance between loudspeaker 135 and circuit board 140 or inner wall 170F of case 170. Circuit board 140 moves toward inner wall 170F of case 170. Loudspeaker 135 contacts stoppers 170A and 170B. Electronic component 150 mounted to circuit board 140 contacts inner wall 170F of case 170, and circuit board 140 receives spring pressure of spring terminal 130 and stops. At this moment, the distance between loudspeaker 135 and inner wall 170F of case 170 is equal to length L2 of stoppers 170A and 170B. Length L2 is determined so that distance L3 between circuit board 140 and loudspeaker 135 is larger than the reversible deformation limit of elastic deformation of spring terminal 130. Even if an excessive impact force is applied to spring terminal 130 by mounting loudspeaker 135 to a deep position of case 170 or by accidentally dropping portable phone 180, stoppers 170A and 170B prevent spring terminal 30 from permanently deforming and being crushed. In other words, stoppers 170A and 170B restrict the movement of loudspeaker 135, so that the movement does not exceed the reversible deformation limit of spring terminal 130.

Stoppers 170A and 170B are made preferably of metallic material. This metallic material prevents stoppers 170A and 170B from bending and breaking even if an excessive force, such as a dropping impact, is applied to the stoppers. Therefore, the stoppers can withstand plural dropping impacts, and have high environmental resistance to heat and chemicals.

Stoppers 170A and 170B may be made of other material having resistance to impact, heat, and chemicals, instead of the metallic material. Case 170 is usually made of resin material by injection molding. For example, stoppers 170A and 170B may be formed unitarily with case 170 by injection molding, hence being produced at high productivity.

Stoppers 170A and 170B having pin shapes and made of metallic material may be formed by insert-molding simultaneously when case 170 is formed by injection molding, and may be fixed to case 170, hence providing stoppers 170A and 170B with strength and reliability, and being produced at high productivity.

Stoppers 170A and 170B may preferably have reinforcing ribs. Even if the excessive force due to dropping impact is applied, the reinforcing rib further increases the resistance of stoppers 170A and 170B to impact, thus reliably protecting spring terminal 130.

Stoppers 170A and 170B prevent spring terminal 130 made of elastic metal from deforming beyond the reversible deformation limit of elastic deformation, and prevent the spring pressure produced by spring terminal 130 from decreasing. Therefore, spring terminal 130 can keep producing large spring pressure, and stably contacts circuit board 140. Thus, even if receiving an impact or vibration, portable phone 180 does not cause contact failure between circuit board 140 and spring terminal 130. Therefore, loudspeaker 135 is driven stably without interrupting the signal to loudspeaker 35, thus providing a reliable portable electronic device, such as a portable phone, having high reliability.

Case 170 has its original function as a case, and has a function as stoppers 170A and 170B of spring terminal 130. The combination of the original function and the impact resistance can reduce the number of components of the portable electronic device of Embodiment 3, accordingly reducing its cost.

Spring terminal 130 is bent by a predetermined amount when loudspeaker 135 is mounted to portable phone 180, and keeps having its shape to apply an appropriate spring pressure to power supply section 140A of circuit component 140. Even when loudspeaker 135 is mounted while being strongly pressed, stoppers 170A and 170B contact loudspeaker 135 to prevent spring terminal 130 to from moving more.

Even if an excessive impact force is applied to spring terminal 130 due to the accidental dropping of portable phone 180, stoppers 170A and 170B prevent spring terminal 130 made of metallic material from deforming and being crushed beyond the reversible deformation limit of elastic deformation, hence preventing the spring pressure produced by spring terminal 130 from decreasing. Thus, spring terminal 130 can keep producing a large spring pressure, and stably contacts power supply section 140A. Even if portable phone 180 receives an impact or vibration, spring terminal 130 does not cause contact failure with power supply section 140A, hence driving loudspeaker 135, namely the electronic component, stably without interrupting a signal to loudspeaker 135.

As shown in FIG. 5, a receiving section for receiving stoppers 170A and 170B is loudspeaker 135 of an electric acoustic transducer, the electronic component having spring terminal 130 mounted thereto. This structure determines the heights of stoppers 170A and 170B accurately. Loudspeaker 135 can have accurate dimensions and be assembled accurately, accordingly determining height L2 of stoppers 170A and 170B accurately.

Stoppers 170A and 170B contact frame 135A and magnetic circuit 135B of loudspeaker 135 to be received by the frame and the magnetic circuit, respectively. Frame 135A is usually made of strong material and is directly mounted to the case. Spring terminal 130 is usually mounted to loudspeaker 135 with reference to the frame, hence determining height L2 of stopper 170A accurately. Frame 135 may be made of resin. In this case, spring terminal 130 may be insert-molded in frame 135. Frame 135A made of resin may have resistance to impact smaller than that of metal, so that magnetic circuit 135B made of metallic material having large resistance to impact receives stopper 170B. Stoppers 170A and 170B are received at two portions of frame 135A and magnetic circuit 135B, respectively, and hence, have height L2 determined accurately, thus having large resistance to impact.

Required reliability level depends on the type of the portable electronic device, so that the stoppers can be provided appropriately according to the level, for example, the number of stoppers may be one. Thus, the reliability of the portable electronic device can be improved.

Spring terminal 130 of Embodiment 3 can be used as a spring terminal which is mounted to a portable electronic device, which produces a spring pressure, and which contacts a power supply section. Loudspeaker 135, an electric acoustic transducer as the electronic component having spring terminal 130 mounted thereto is mounted to a portable phone as the portable electronic device of Embodiment 3. However, the kind of the electronic component and the kind of the portable electronic device are not limited to these.

Exemplary Embodiment 4

Figure 6:
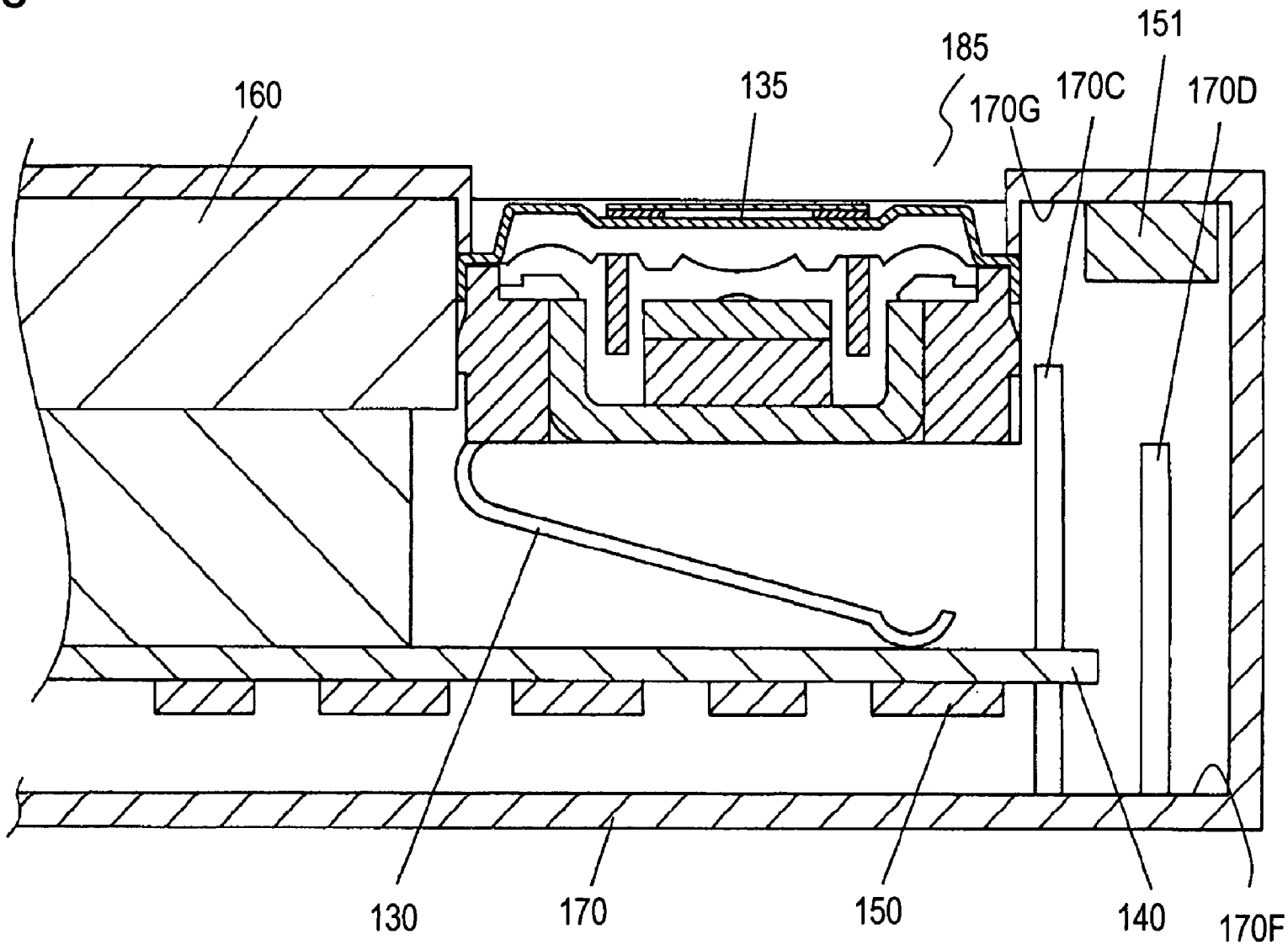
FIG. 6 is a sectional view of a portable electronic device in accordance with Exemplary Embodiment 4 of the invention.

FIG. 6 is a sectional view of portable phone 185, a portable electronic device in accordance with Exemplary Embodiment 4 of the present invention. In FIG. 6, elements similar to those in embodiment 3 shown in FIG. 4 are denoted by the same reference numerals, and their description is omitted.

Stoppers 170C and 170D extend from inner wall 170F of case 170 facing loudspeaker 135, namely an electronic component, toward inner wall 170G facing inner wall 170F of case 170, and are made of metallic material having pin shapes. Stoppers 170C and 170D are received by inner wall 170G of case 170, namely a component other than electronic component (loudspeaker) 135, and component 151 other than loudspeaker 135 that is an electronic component, respectively. If loudspeaker 135 as the electronic component, having spring terminal 130 has insufficient resistance to impact, component 151 out of case 170 and other components is used as the receiving section for receiving stoppers 170C and 170D. This structure improves reliability and safety, accordingly improving reliability and safety of the portable electronic device, such as portable phone 185.

INDUSTRIAL APPLICABILITY

A portable electronic device according to the present invention has large resistance to impact and has high reliability.

The invention claimed is:

1. A portable electronic device comprising:

a case;

an electronic component accommodated in said case;

a spring terminal accommodated in said case and extending from said electronic component, said spring terminal being arranged for supplying power to said electronic component, said spring terminal being made of elastic metallic material having a reversible deformation limit of elastic deformation;

a circuit component accommodated in said case and having a power supply section, said power supply section contacting said spring terminal; and a stopper, not movable with said circuit component upon movement of said circuit component away from said electronic component, for restricting movement of said electronic component to within the reversible deformation limit of said spring terminal, said stopper being accommodated in said case and extending from an inner wall of said case;

wherein said circuit component is movable, within said case, with respect to said stopper away from said electronic component to prevent said circuit component from becoming closer than a predetermined distance from said electronic component.

2. The portable electronic device of claim 1, wherein said stopper is configured and arranged so that, upon movement of said electronic component toward said stopper from a position spaced away from said stopper, said stopper is operable to contact said electronic component to restrict the movement of the electronic component.

3. The portable electronic device of claim 1, wherein said electronic component comprises an electric acoustic transducer.

4. The portable electronic device of claim 3, wherein said electric acoustic transducer includes a frame and a magnetic circuit, and said stopper is operable to contact said frame to restrict the movement of said electronic component.

5. The portable electronic device of claim 3, wherein said electric acoustic transducer includes a frame and a magnetic circuit, and said stopper is operable to contact said magnetic circuit to restrict the movement of said electronic component.

6. The portable electronic device of claim 1, further comprising a component, wherein said stopper is operable to contact said component to restrict the movement of said electronic component.

7. The portable electronic device of claim 1, wherein said stopper is formed unitarily with said case.

* * * * *